US010330290B2

(12) United States Patent
Wu

(10) Patent No.: US 10,330,290 B2
(45) Date of Patent: Jun. 25, 2019

(54) SALT LAMP

(71) Applicant: Dongguan Yali Electric Co., Ltd., Dongguan (CN)

(72) Inventor: Hai-Feng Wu, Dongguan (CN)

(73) Assignee: Dongguan Yali Electric Co., Ltd., Dongguan (CN)

( * ) Notice: Subject to any disclaimer, the term of this patent is extended or adjusted under 35 U.S.C. 154(b) by 0 days.

(21) Appl. No.: 15/786,727

(22) Filed: Oct. 18, 2017

(65) Prior Publication Data

US 2019/0032901 A1 Jan. 31, 2019

(30) Foreign Application Priority Data

Jul. 25, 2017 (CN) ..... 2017 2 0906649 U

(51) Int. Cl.

| | |
|---|---|
| ***F21V 21/02*** | (2006.01) |
| *F21V 19/04* | (2006.01) |
| *F21V 3/06* | (2018.01) |

(52) U.S. Cl.

CPC ..... *F21V 21/02* (2013.01); *F21V 3/06* (2018.02); *F21V 19/04* (2013.01)

(58) Field of Classification Search

CPC ..... F21V 21/02; F21V 19/04; F21V 3/06

USPC ..... 362/382, 441, 433

See application file for complete search history.

(56) References Cited

U.S. PATENT DOCUMENTS

| | | | | |
|---|---|---|---|---|
| 8,602,608 | B2 * | 12/2013 | Derks | F21V 15/01 362/249.02 |
| 8,668,363 | B2 * | 3/2014 | Vogt | F21V 19/003 257/99 |
| 8,702,274 | B2 * | 4/2014 | Breidenassel | F21V 17/12 362/249.01 |
| 8,814,399 | B2 * | 8/2014 | Osawa | F21V 23/06 362/382 |
| 2010/0124050 | A1 * | 5/2010 | Hau | H02J 50/10 362/183 |
| 2011/0317403 | A1 * | 12/2011 | Fournier | F21S 6/001 362/183 |
| 2012/0106123 | A1 * | 5/2012 | Treurniet | F21S 6/004 362/20 |
| 2013/0329406 | A1 * | 12/2013 | Lederer | F21L 4/08 362/183 |
| 2014/0313694 | A1 * | 10/2014 | Patton | F21S 10/046 362/96 |
| 2015/0070874 | A1 * | 3/2015 | Beesley | H05B 33/0803 362/96 |

(Continued)

*Primary Examiner* — Julie A Bannan

(74) *Attorney, Agent, or Firm* — Alan D. Kamrath; Mayer & Williams PC

(57) ABSTRACT

A salt lamp includes a lampshade, a base detachably mounted on the lampshade, and a lampwick secured on the base. The lampshade is connected with an upper connecting cap. The base includes a lower connecting cap detachably connected with the upper connecting cap. The upper connecting cap is provided with a plurality of locking pieces. The lower connecting cap is provided with a plurality of slideways corresponding to and allowing movement of the locking pieces of the upper connecting cap. Each of the slideways is provided with an opening allowing entrance of each of the locking pieces, a slope face guiding movement of each of the locking pieces, and a projection locked onto each of the locking pieces to secure the upper connecting cap to the lower connecting cap.

4 Claims, 9 Drawing Sheets

(56) References Cited

U.S. PATENT DOCUMENTS

| | | | | |
|---|---|---|---|---|
| 2015/0233555 | A1* | 8/2015 | Poon | F21V 19/04<br>362/569 |
| 2016/0161096 | A1* | 6/2016 | Boulanger | F21V 21/02<br>362/368 |

* cited by examiner

SALT LAMP

BACKGROUND OF THE INVENTION

1. Field of the Invention

The present invention relates to a lamp and, more particularly, to a salt lamp.

2. Description of the Related Art

A conventional salt lamp comprises a lampshade, a base secured on the lampshade, and a lampwick secured on the base and received in the lampshade. The conventional salt lamp contains a salt rock therein. However, the base and the lampshade are fastened by multiple locking screws, so that it is necessary for the user to disassemble the whole salt lamp to clean, repair or replace the lampwick, thereby causing inconvenience to the user. In addition, when the salt lamp is detached frequently for replacing or cleaning the lampwick, the salt lamp is easily worn out.

BRIEF SUMMARY OF THE INVENTION

The primary objective of the present invention is to provide a salt lamp having a detachable structure.

In accordance with the present invention, there is provided a salt lamp comprising a lampshade, a base detachably mounted on the lampshade, and a lampwick secured on the base. The lampshade has a bottom connected with an upper connecting cap. The base includes a lower connecting cap detachably connected with the upper connecting cap of the lampshade. The upper connecting cap of the lampshade is provided with a plurality of locking pieces. The lower connecting cap of the base is provided with a plurality of slideways corresponding to and allowing movement of the locking pieces of the upper connecting cap. Each of the slideways of the lower connecting cap is provided with an opening allowing entrance of each of the locking pieces of the upper connecting cap, a slope face guiding movement of each of the locking pieces of the upper connecting cap, and a projection locked onto each of the locking pieces of the upper connecting cap to secure the upper connecting cap to the lower connecting cap.

Preferably, the base further includes a circuit board electrically connected with the lampwick, and an electric plug connected with the circuit board and electrically connected with an external power supply.

Preferably, the a guiding cylinder is mounted on an outer face of the lampwick and is connected with the base.

Preferably, the base further includes a bottom cover connected with the lower connecting cap, and a retaining ring mounted on a side face of the lower connecting cap.

Preferably, the salt lamp further comprises a plurality of screws connecting the bottom cover with the lower connecting cap, connecting the guiding cylinder with the upper connecting cap, and connecting the lampshade with the upper connecting cap.

Preferably, the lampwick is connected with the lower connecting cap by a plurality of bolts.

Preferably, the lower connecting cap has a periphery provided with an annular water drain channel which is provided with a water drain hole connected outward from the lower connecting cap.

According to the primary advantage of the present invention, the lampwick is secured on the base, and the base is detachably mounted on the lampshade, so that the base can be detached from the lampshade for cleaning, maintenance or replacement of the lampwick.

According to another advantage of the present invention, each of the locking pieces of the upper connecting cap is locked by the projection of each of the slideways, to prevent the upper connecting cap from being rotated reversely and detached from the lower connecting cap According to a further advantage of the present invention, the lampwick is moved into the lampshade easily by guidance of the guiding cylinder According to a further advantage of the present invention, the guiding cylinder protects the lampwick during assembly, disassembly and replacement of the lampwick.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
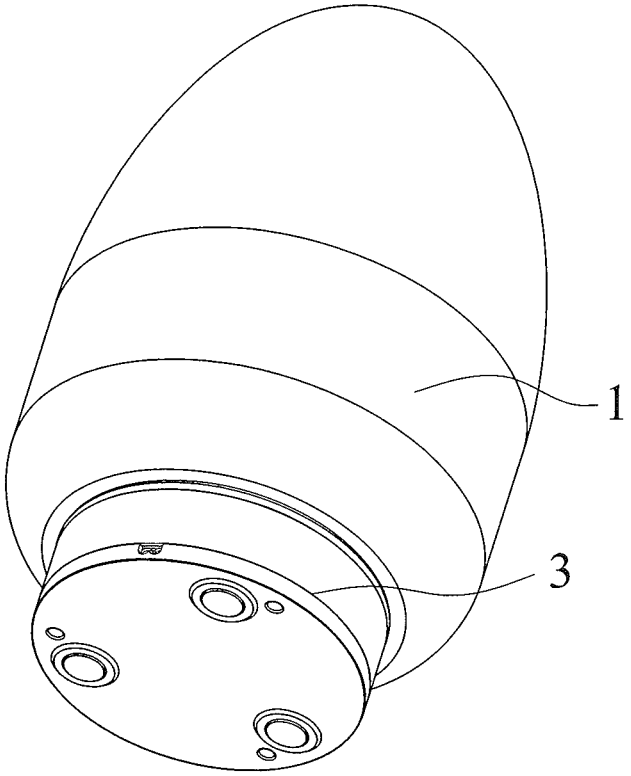
FIG. 1 is a perspective view of a salt lamp in accordance with the preferred embodiment of the present invention.
Figure 2:
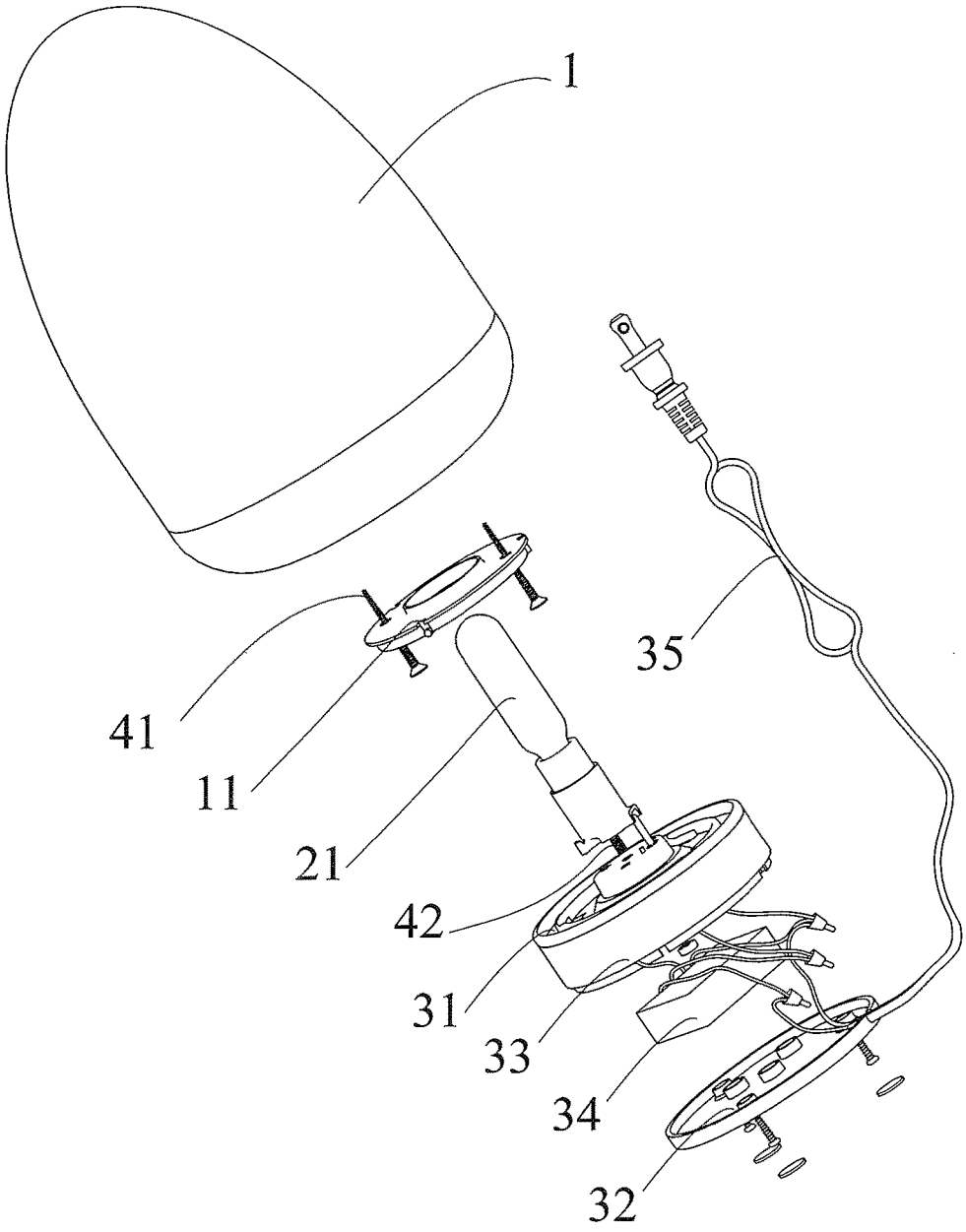
FIG. 2 is a partially exploded perspective view of the salt lamp in accordance with the preferred embodiment of the present invention.
Figure 3:
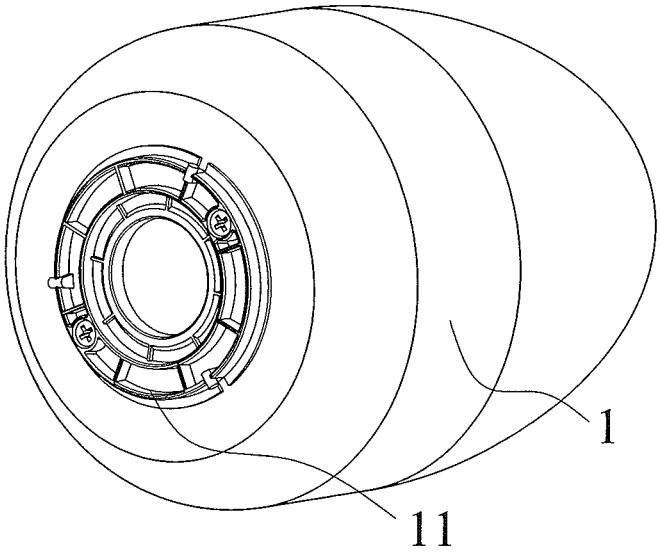
FIG. 3 is a perspective view showing connection of a lampshade and an upper connecting cap in accordance with the preferred embodiment of the present invention.
Figure 4:
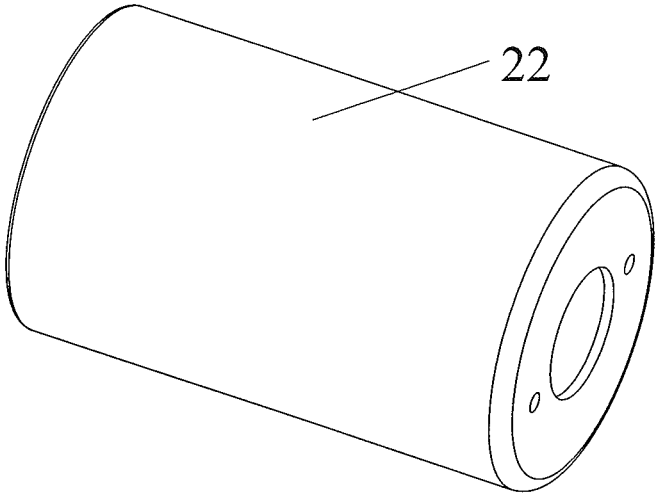
FIG. 4 is a perspective view of a guiding cylinder in accordance with the preferred embodiment of the present invention.
Figure 5:
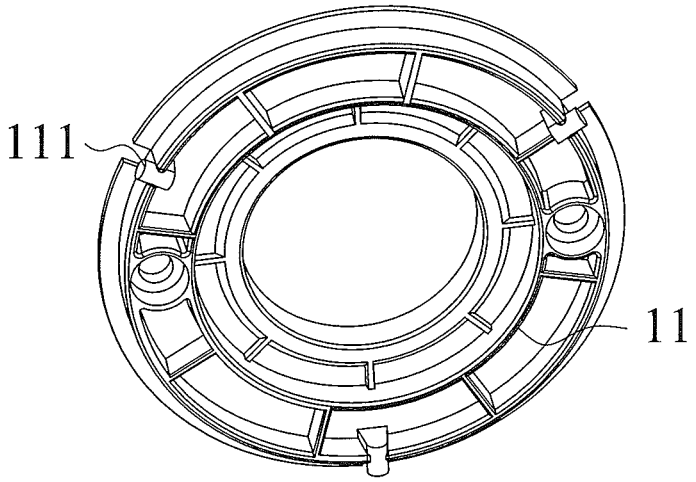
FIG. 5 is a perspective view of the upper connecting cap in accordance with the preferred embodiment of the present invention.
Figure 6:
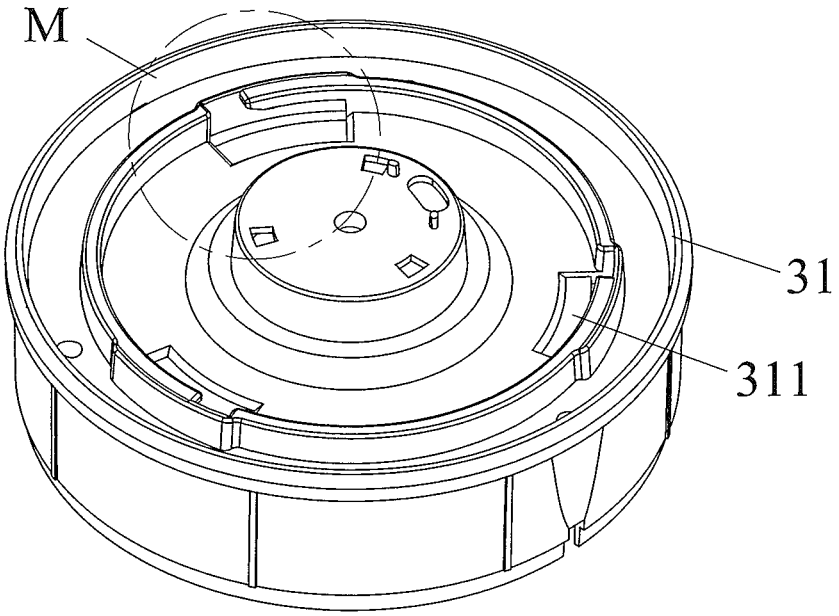
FIG. 6 is a front perspective view of a lower connecting cap in accordance with the preferred embodiment of the present invention.
Figure 7:
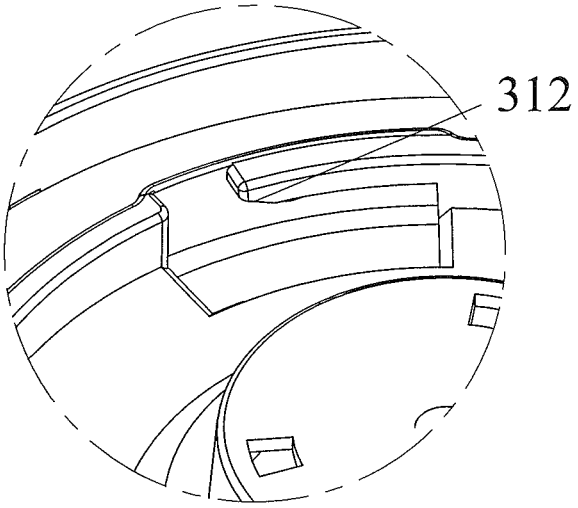
FIG. 7 is a locally enlarged view of the lower connecting cap taken along circle "M" as shown in FIG. 6.
Figure 8:
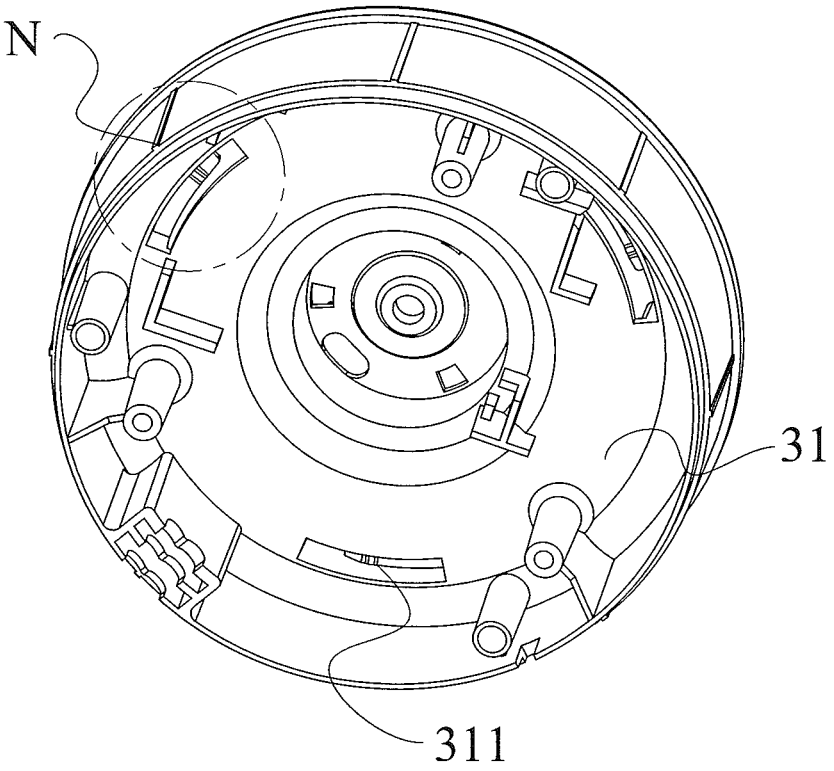
FIG. 8 is a rear perspective view of the lower connecting cap in accordance with the preferred embodiment of the present invention.
Figure 9:
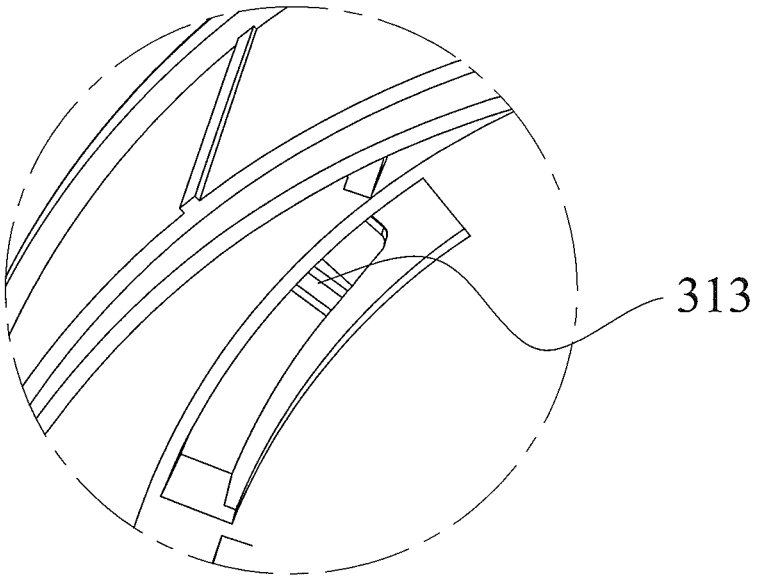
FIG. 9 is a locally enlarged view of the lower connecting cap taken along circle "N" as shown in FIG. 8.

Referring to FIGS. 1-9, a salt lamp in accordance with the preferred embodiment of the present invention comprises a lampshade 1, a base 3 detachably mounted on the lampshade 1, and a lampwick 21 secured on the base 3. The lampshade 1 has a bottom connected with an upper connecting cap 11. The base 3 includes a lower connecting cap 31 detachably connected with the upper connecting cap 11 of the lampshade 1.

In the preferred embodiment of the present invention, the upper connecting cap 11 of the lampshade 1 is provided with a plurality of locking pieces 111. The lower connecting cap 31 of the base 3 is provided with a plurality of slideways 311 corresponding to and allowing movement of the locking pieces 111 of the upper connecting cap 11. Each of the slideways 311 of the lower connecting cap 31 is provided with an opening allowing entrance of each of the locking pieces 111 of the upper connecting cap 11, a slope face 312 guiding movement of each of the locking pieces 111 of the upper connecting cap 11, and a projection 313 locked onto each of the locking pieces 111 of the upper connecting cap 11 to secure the upper connecting cap 11 to the lower connecting cap 31.

In assembly, when the upper connecting cap 11 is mounted on the lower connecting cap 31, each of the locking pieces 111 of the upper connecting cap 11 extends through the opening into each of the slideways 311 of the lower connecting cap 31. Then, the upper connecting cap 11 is rotated relative to the lower connecting cap 31, so that each of the locking pieces 111 of the upper connecting cap 11 is moved on the slope face 312 to reach the projection 313 of each of the slideways 311. After each of the locking pieces 111 of the upper connecting cap 11 passes the projection 313 of each of the slideways 311, each of the locking pieces 111 of the upper connecting cap 11 is locked by the projection 313 of each of the slideways 311, so that the upper connecting cap 11 is locked onto the lower connecting cap 31. It is appreciated that, the locking pieces 111 of the upper connecting cap 11 are moved easily into the slideways 311 of the lower connecting cap 31 by guidance of the slope face 312. In addition, the locking pieces 111 of the upper connecting cap 11 are positioned in the slideways 311 of the lower connecting cap 31 by locking of the projection 313.

On the contrary, when the upper connecting cap 11 is rotated reversely relative to the lower connecting cap 31, each of the locking pieces 111 of the upper connecting cap 11 is unlocked and detached from the projection 313 of each of the slideways 311 and is moved on the slope face 312 to reach the opening of each of the slideways 311, so that the locking pieces 111 of the upper connecting cap 11 are released from the slideways 311 of the lower connecting cap 31, and the upper connecting cap 11 is detached from the lower connecting cap 31.

In the preferred embodiment of the present invention, the base 3 further includes a circuit board 34 electrically connected with the lampwick 21, and an electric plug 35 connected with the circuit board 34 and electrically connected with an external power supply.

In the preferred embodiment of the present invention, a guiding cylinder 22 is mounted on an outer face of the lampwick 21 and is connected with the base 3. The guiding cylinder 22 protects the lampwick 21 during detachment and replacement of the lampwick 21 to prevent the lampwick 21 from being worn out or broken during detachment of the salt lamp. In addition, the guiding cylinder 22 guides the lampwick 21 during assembly of the lampwick 21.

In the preferred embodiment of the present invention, the base 3 further includes a bottom cover 32 connected with the lower connecting cap 31, and a retaining ring 33 mounted on a side face of the lower connecting cap 31. The bottom cover 32 and the lower connecting cap 31 form a chamber therebetween to receive the circuit board 34.

In the preferred embodiment of the present invention, the salt lamp further comprises a plurality of screws 41 connecting the bottom cover 32 with the lower connecting cap 31, connecting the guiding cylinder 22 with the upper connecting cap 11, and connecting the lampshade 1 with the upper connecting cap 11.

In the preferred embodiment of the present invention, the lampwick 21 is connected with the lower connecting cap 31 by a plurality of bolts 42.

In the preferred embodiment of the present invention, the lower connecting cap 31 has a periphery provided with an annular water drain channel 314 which is provided with a water drain hole 315 connected outward from the lower connecting cap 31. Thus, the water flowing downward from the lampshade 1 flows through the water drain channel 314 and the water drain hole 315 of the lower connecting cap 31 and is drained outward from the salt lamp.

In the preferred embodiment of the present invention, the base 3 further includes a humidity control switch. The surface of the salt lamp absorbs water in the wet weather. Thus, when the humidity of the salt lamp reaches a preset value, the humidity control switch is started to turn on the lampwick 21 so as to evaporate the water on the surface of the salt lamp.

Accordingly, the lampwick 21 is secured on the base 3, and the base 3 is detachably mounted on the lampshade 1, so that the base 3 can be detached from the lampshade 1 for cleaning, maintenance or replacement of the lampwick 21. In addition, each of the locking pieces 111 of the upper connecting cap 11 is locked by the projection 313 of each of the slideways 311, to prevent the upper connecting cap 11 from being rotated reversely and detached from the lower connecting cap 31. Further, the lampwick 21 is moved into the lampshade 1 easily by guidance of the guiding cylinder 22. Further, the guiding cylinder 22 protects the lampwick 21 during assembly, disassembly and replacement of the lampwick 21.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A salt lamp comprising:

a lampshade;

a base detachably mounted on the lampshade; and a light source secured on the base;

wherein:

the lampshade has a bottom connected with an upper connecting cap;

the base includes a lower connecting cap detachably connected with the upper connecting cap of the lampshade;

the upper connecting cap of the lampshade is provided with a plurality of locking pieces;

the lower connecting cap of the base is provided with a plurality of slideways corresponding to and allowing movement of the locking pieces of the upper connecting cap;

each of the slideways of the lower connecting cap is provided with an opening allowing entrance of each of the locking pieces of the upper connecting cap, a slope face guiding movement of each of the locking pieces of the upper connecting cap, and a projection locked onto each of the locking pieces of the upper connecting cap to secure the upper connecting cap to the lower connecting cap;

the base further includes a circuit board electrically connected with the light source, and an electric plug connected with the circuit board and electrically connected with an external power supply;

the a guiding cylinder is mounted on an outer face of the light source and is connected with the base; and the base further includes a bottom cover connected with the lower connecting cap, and a retaining ring mounted on a side face of the lower connecting cap.

2. The salt lamp of claim 1, further comprising:

a plurality of screws connecting the bottom cover with the lower connecting cap, connecting the guiding cylinder with the upper connecting cap, and connecting the lampshade with the upper connecting cap.

3. The salt lamp of claim 1, wherein the light source is connected with the lower connecting cap by a plurality of bolts.

4. A salt lamp comprising:

a lampshade;

a base detachably mounted on the lampshade; and a light source secured on the base;

wherein:

the lampshade has a bottom connected with an upper connecting cap;

the base includes a lower connecting cap detachably connected with the upper connecting cap of the lampshade;

the upper connecting cap of the lampshade is provided with a plurality of locking pieces;

the lower connecting cap of the base is provided with a plurality of slideways corresponding to and allowing movement of the locking pieces of the upper connecting cap;

each of the slideways of the lower connecting cap is provided with an opening allowing entrance of each of the locking pieces of the upper connecting cap, a slope face guiding movement of each of the locking pieces of the upper connecting cap, and a projection locked onto each of the locking pieces of the upper connecting cap to secure the upper connecting cap to the lower connecting cap; and the lower connecting cap has a periphery provided with an annular water drain channel which is provided with a water drain hole connected outward from the lower connecting cap.

* * * * *